US006873097B2

(12) United States Patent
Pei et al.

(10) Patent No.: US 6,873,097 B2
(45) Date of Patent: Mar. 29, 2005

(54) CLEANING OF CATHODE-RAY TUBE DISPLAY

(75) Inventors: Shiyou Pei, Saratoga, CA (US); Colin D. Stanners, San Jose, CA (US); Frederick K. Byers, Los Gatos, CA (US)

(73) Assignees: Candescent Technologies Corporation, Los Gatos, CA (US); Candescent Intellectual Property Services, Inc., Los Gatos, CA (US)

( * ) Notice: Subject to any disclaimer, the term of this patent is extended or adjusted under 35 U.S.C. 154(b) by 278 days.

(21) Appl. No.: 09/896,249

(22) Filed: Jun. 28, 2001

(65) Prior Publication Data

US 2003/0001492 A1 Jan. 2, 2003

(51) Int. Cl.[7] ..... H01J 1/62; H01J 63/04; H01J 9/00

(52) U.S. Cl. ..... 313/495; 313/577; 313/497; 313/309; 313/637; 445/24; 445/38; 445/53; 445/6; 445/59

(58) Field of Search ..... 445/577, 497, 445/309, 637, 495, 24, 38, 6, 59, 53, 5, 41; 313/577, 637, 496, 547, 551, 552, 562, 563, 497

(56) References Cited

U.S. PATENT DOCUMENTS

| | | | | | |
|---|---|---|---|---|---|
| 4,346,951 | A | * | 8/1982 | Caras et al. | 445/25 |
| 4,919,157 | A | | 4/1990 | Mateias | 134/2 |
| 5,520,563 | A | * | 5/1996 | Wallace et al. | 445/24 |
| 5,559,389 | A | | 9/1996 | Spindt et al. | 313/310 |
| 5,564,959 | A | | 10/1996 | Spindt et al. | 445/24 |
| 5,605,484 | A | | 2/1997 | Bailey et al. | 445/59 |
| 5,635,790 | A | | 6/1997 | Meyer et al. | 313/309 |
| 5,655,886 | A | * | 8/1997 | Alderson | 313/309 |
| 5,853,492 | A | | 12/1998 | Cathey et al. | 134/3 |
| 5,977,706 | A | | 11/1999 | Cho et al. | 313/553 |
| 6,004,180 | A | | 12/1999 | Knall et al. | 445/59 |
| 6,005,343 | A | * | 12/1999 | Rakhimov et al. | 313/493 |
| 6,013,980 | A | | 1/2000 | Goel et al. | 313/495 |
| 6,042,441 | A | * | 3/2000 | Konuma | 445/6 |
| 6,113,708 | A | | 9/2000 | Hopple et al. | 134/7 |
| 6,114,694 | A | * | 9/2000 | Ito | 445/38 |
| 6,139,390 | A | | 10/2000 | Pothoven et al. | 445/41 |
| 6,187,603 | B1 | | 2/2001 | Haven et al. | 438/20 |

OTHER PUBLICATIONS

Brodie, et al., "Vacuum Microelectronics," *Advances In Electronics And Electron Physics*, vol. 83, 1992, pp. 1–106.

(Continued)

*Primary Examiner*—Nimeshkumar D. Patel
*Assistant Examiner*—Mariceli Santiago
(74) *Attorney, Agent, or Firm*—Ronald J. Meetin

(57) ABSTRACT

Inert gas provided at a suitable level inside a hermetically sealed cathode-ray tube display, typically of the flat-panel type, enables the display's electron-emitting device (20) to be automatically cleaned during display operation subsequent to final display sealing. Upon being struck by electrons emitted by the electron-emitting device, atoms (68) of the inert gas ionize to produce positively charged ions (124) which travel backward to the electron-emitting device and dislodge overlying contaminant material (130 and 132). A getter (26) collects dislodged contaminant. A reservoir (28) provides inert gas to replace inert gas lost during the cleaning process.

58 Claims, 4 Drawing Sheets

OTHER PUBLICATIONS

Chalamala, et al., "Operation of FEAs in Hydrogen and the Development of Thin Film Metal Hydrides for Integration into FEDs", *SID 01 Digest*, 2001, pp. 89–91.

Chalamala, et al., "Residual Gas Effects on the Emission Characteristics of Active Mo Field–Emission Cathode Arrays,", *SID 98 Digest*, 1998, pp. 107–110.

Chalamala, et al., "Surface conditioning of active molybedenum field emission cathode arrays with $H_2$ and helium," *J. Vac. Sci. Technol.*, Sep./Oct. 1998, pp. 2855–2858.

Hopple, et al., "FED Life and Relibility," *Information Display*, Apr./May 2000, pp. 34–37.

Jo, et al., "Analysis of field emission characteristics of hydrogen–adsorbed silicon surface," *Appl. Phys. Lett.*, Apr. 15, 1996, pp. 2234–2236.

Kim, et al., "High–Resolution 5–8in. Full–Color FEDs with New Aging Technique," *Proceedings of SID '98*, Int'l. Symp., May 17–22, 1998, 4 pgs.

Reuss, et al., "New Insights Into the Degradation of Field Emission Displays," *SID 01 Digest*, 2001, pp. 81–83.

Schwoebel, et al., "Field–emitter array performance enhancement using hydrogen glow discharges," *Appl. Phys. Lett.*, Jul. 1993, pp. 33–35.

* cited by examiner

CLEANING OF CATHODE-RAY TUBE DISPLAY

FIELD OF USE

This invention relates to cathode-ray tube ("CRT") displays, especially CRT displays of the flat-panel type.

BACKGROUND

A flat-panel CRT display basically consists of an electron-emitting device and a light-emitting device that operate at low internal pressure, typically from $10^{-6}$ torr to $10^{-2}$ torr. The electron-emitting device, commonly referred to as a cathode, contains electron-emissive elements allocated into a group of laterally separated electron-emissive regions for emitting electrons over a relatively wide area. The emitted electrons are directed towards light-emissive regions distributed over a corresponding area in the light-emitting device. Upon being struck by the electrons, the light-emissive regions emit light that produces an image on the viewing surface of the display.

The electron-emissive elements need to be clean during display operation. Contaminants that build up on the surfaces of the electron-emissive elements act to increase the height and/or width of the electron tunneling barriers. This leads to higher operating voltages for the displays, and attendant emission degradation. Also, contamination of the electron-emissive surfaces produces emission non-uniformity and leads to undesirable image artifacts. Degraded display performance, even display failure, is commonly the result.

Various techniques have been reported for cleaning electron-emissive elements in flat-panel CRT displays. For example, see U.S. Pat. Nos. 5,635,790 and 6,004,180. The cleaning techniques described in these two patents are performed during display fabrication and thus prior to final display sealing including evacuation to the desired initial internal display pressure. The cleaning techniques may, as occurs in some of the techniques described in U.S. Pat. No. 6,004,180, entail operating the electron-emissive elements. Nonetheless, the cleaning techniques are still completed prior to final display sealing.

In addition to becoming contaminated during display fabrication, electron-emissive elements in a flat-panel CRT display also become contaminated during display operation subsequent to final display sealing. For instance, material that contaminates the electron-emissive elements can be released from the display's light-emitting device when it is struck by electrons emitted by the display's electron-emitting device. Accordingly, it would be desirable to have technique for cleaning a flat-panel CRT display during display operation subsequent to final display sealing.

GENERAL DISCLOSURE OF THE INVENTION

The present invention furnishes a CRT display, typically a flat-panel CRT display, having a built-in capability for cleaning the display's electron-emitting device. That is, the electron-emitting device is automatically cleaned during normal display operation subsequent to final display sealing and evacuation to a low internal display pressure. The self-cleaning capability is achieved with inert gas provided inside the display.

The pressure (or density) of gas inside a flat-panel CRT display is normally made low for two main reasons: (1) to avoid interfering with the flow of electrons from the display's electron-emitting device to the display's light-emitting device and (2) to avoid contaminating the electron-emitting and light-emitting devices. While inert gases do have some chemical reactivity, the level of chemical reactivity of an inert gas compared to a typical non-inert element or compound is generally so low that the presence of inert gas inside a flat-panel CRT display does not usually cause appreciable contamination of the display's electron-emitting and light-emitting devices. Hence, the second reason for avoiding gas inside a flat-panel CRT display generally does not apply to inert gases.

Some inert gas is invariably present inside a conventional hermetically sealed CRT display. Argon is typically the most prevalent inert gas inside a conventional CRT display. The substantial presence of argon inside a conventional CRT display can arise for various reasons.

In any event, we have recognized that some of the electrons emitted by the electron-emitting device of a conventional hermetically sealed CRT display during display operation collide with atoms of the inert gas inside the display to produce positively charged ions which travel backward toward the electron-emitting device. The positively charged inert-gas ions bombard contaminant material on the electron-emitting device and cause some of the contaminant material to be dislodged from, and thereby be removed from, the electron-emitting device. Hence, a conventional CRT display has an inherent capability for automatically removing contaminant material from the electron-emitting device during display operation subsequent to final display sealing. However, the partial pressure of the inert gas inside a conventional CRT display is normally quite low so that the display's inherent capability for removing contaminant material from the electron-emitting device is quite low.

Also, some of the positively charged inert-gas ions lodge (or become trapped) in the electron-emitting device of a conventional CRT display and are effectively lost during display operation. Consequently, the inherent capability which a conventional CRT display has for removing contaminant material from the display's electron-emitting device degrades with operational time and eventually drops essentially to zero. Furthermore, contaminant material removed from the electron-emitting device due to bombardment by inert-gas ions can later return to the electron-emitting device and re-contaminate it.

With the foregoing in mind, the CRT display of the invention is constituted with an electron-emitting device and a light-emitting device coupled to the electron-emitting device to form a hermetically sealed enclosure. Electrons emitted by the electron-emitting device pass through the sealed enclosure to strike the light-emitting device and cause it to emit light that produces an image. Inert gas is present in open space of the sealed enclosure.

In accordance with the invention, the inert gas in the open space of the sealed enclosure of the present CRT display consists of at least one of (a) helium at a partial pressure of at least $2\times10^{-5}$ torr, (b) argon at a partial pressure of at least $3\times10^{-5}$ torr, and (c) one or more of neon, krypton, xenon, and radon at a partial pressure of at least $5\times10^{-7}$ torr. As little as one of these six inert gases may be present in the sealed enclosure at a partial pressure of at least the minimum partial pressure given here for that inert gas or gases. The partial pressure of the inert gas is normally at least $1\times10^{-5}$ torr in the case of neon and at least $1\times10^{-6}$ torr in the case of krypton.

The present CRT display, again typically a flat-panel CRT display, operates generally in the manner described above with respect to the generation of positively charged inert-gas ions for bombarding contaminant material on the electron-emitting device. The partial pressures of the various inert gases utilized to implement the contaminant-removal capability in a CRT display configured according to the invention are normally considerably greater than the partial pressures of those inert gases present in a conventional CRT display. Accordingly, the capability for automatically removing contaminant material from the electron-emitting device is considerably greater in the present CRT display than in a conventional CRT display.

The present CRT display preferably includes a reservoir for supplying inert gas to the open space of the display's sealed enclosure. The reservoir replaces inert gas which lodges in the electron-emitting device (or elsewhere) during the ion-bombardment process and is effectively lost during display operation. As a result, the CRT display of the invention can maintain an adequate level of contaminant-removal capability and substantially avoids the loss of contaminant-removal capability which occurs with operational time in a conventional CRT display. When the present display includes the inert-gas reservoir, the partial pressure of all the inert gas in the sealed enclosure is at least $5\times10^{-7}$ torr. The minimum partial pressures given above for helium, for argon, and for one or more of neon, krypton, xenon, and radon, generally apply to the situation in which the inert-gas reservoir is employed in the display except that the minimum partial pressure of argon is slightly lower, typically as little as $1\times10^{-5}$ torr.

The inert-gas reservoir can be implemented as a container that encloses the replacement inert gas. The container has a wall, typically gas permeable, through which the replacement inert gas passes from the container into the sealed enclosure. Additionally or alternatively, the reservoir can be implemented in the form of one or more pieces of (a) inert-gas compound material, (b) absorbent material charged with inert gas, or/and (c) material impregnated with inert gas.

The CRT display of the invention also preferably includes a getter for collecting non-inert material. The getter collects contaminant material dislodged from the electron-emitting device and thereby prevents that material from re-contaminating the electron-emitting device. The getter is preferably positioned close to electron-emissive regions where display-damaging contaminant can accumulate so as to reduce the likelihood that dislodged contaminant material will return to those regions. For example, the getter can be distributed across the active electron-emitting portion of the electron-emitting device. Importantly, the getter normally does not collect inert gas to a significant degree and therefore does not cause the ion-bombardment self-cleaning capability of the invention to degrade significantly with time.

In short, the present inert-gas cleaning technique is highly advantageous because it enables the electron-emitting device of a CRT display, especially one of the flat-panel type, to be cleaned subsequent to final display sealing. The invention thus provides an important and substantial advance.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

A flat-panel CRT display having a built-in capability, in accordance with the invention, for automatically cleaning the display's electron-emitting device during normal display operation is described below. The present flat-panel CRT display is typically suitable for a flat-panel television or a flat-panel video monitor for a personal computer, a laptop computer, a workstation, or a hand-held device such as a personal digital assistant.

A flat-panel CRT display whose electron-emitting device is cleaned according to the invention is typically a color display but can be a monochrome, e.g., black-and-white or black-and-green, display. Each electron-emissive region and the corresponding oppositely positioned light-emissive region form a pixel in a monochrome display, and a sub-pixel in a color display. A color pixel typically consists of three sub-pixels, one for red, another for blue, and the third for green.

In the following description, the term "electrically insulating" or "dielectric" generally applies to materials having a resistivity greater than $10^{10}$ ohm-cm. The term "electrically non-insulating" thus refers to materials having a resistivity of no more than $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 10 volts/$\mu$m.

Figure 1A:
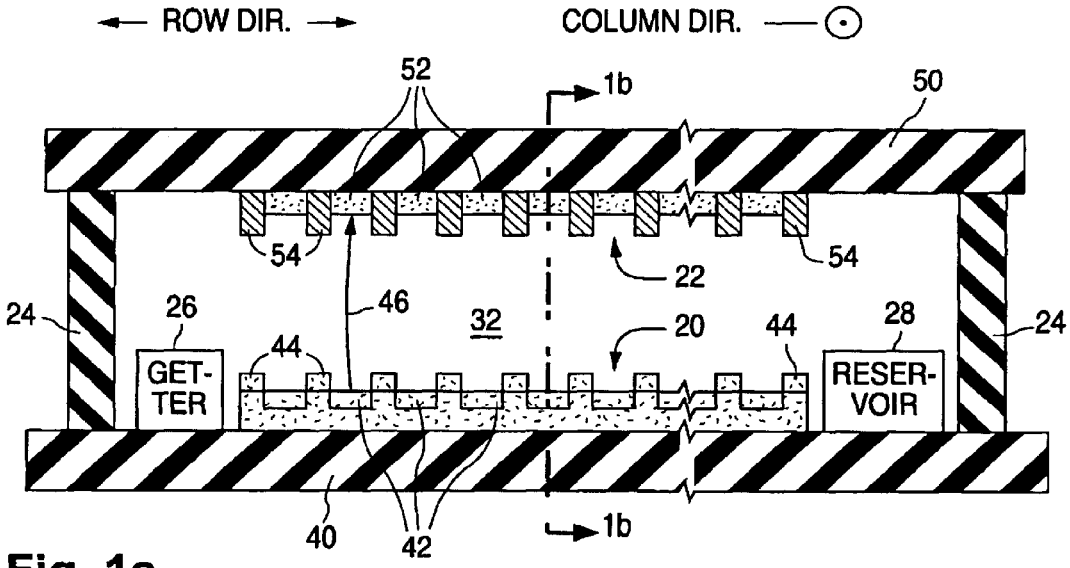
FIGS. 1*a* and 1*b* are cross-sectional side views, taken perpendicular to each other, of a flat-panel CRT display provided with a self-cleaning capability according to the invention. The cross section of FIG. 1*b* is taken through plane 1*b*—1*b* in FIG. 1*a*. The cross section of FIG. 1*a* is taken through plane 1*a*—1*a* in FIG. 1*b*.
Figure 1B:
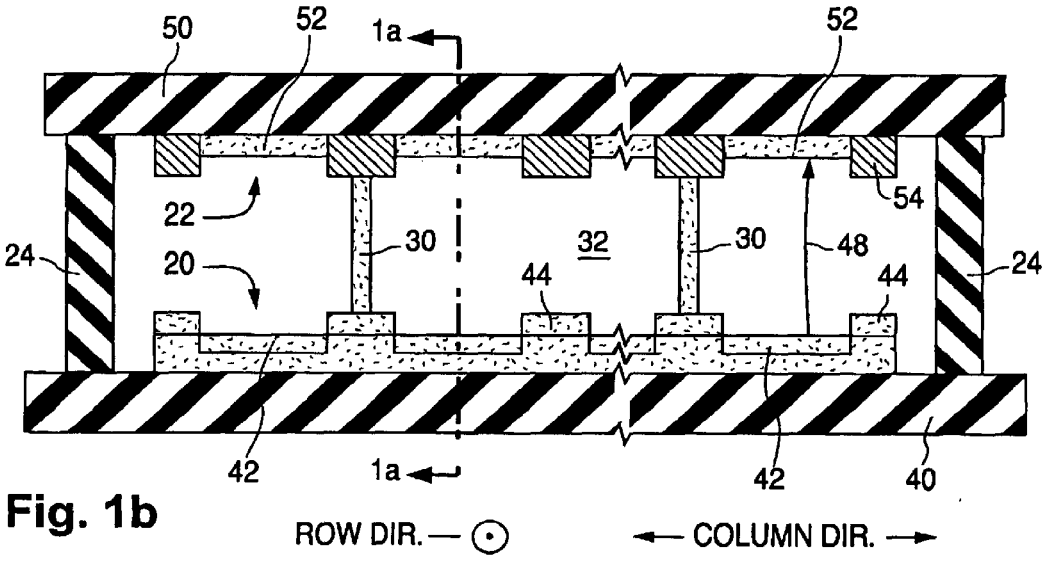

FIGS. 1*a* and 1*b* schematically illustrate intersecting side cross sections of a hermetically sealed flat-panel CRT display provided with a self-cleaning capability in accordance with the invention's teachings. The side cross sections of FIGS. 1*a* and 1*b* are taken perpendicular to each other. The flat-panel CRT display of FIGS. 1*a* and 1*b* can be characterized by two perpendicular lateral directions referred to here as the row and column directions. FIG. 1 a can, for example, represent a cross section of the display as viewed in the column direction. FIG. 1*b* then represents a cross section of the display as viewed in the row direction.

The flat-panel CRT display of FIGS. 1*a* and 1*b* (collectively "FIG. 1") consists of an electron-emitting device 20, an oppositely positioned light-emitting device 22, an annular rectangular outer wall 24, a getter 26, an optional inert-gas reservoir 28, and a group of spacers 30. Electron-emitting device 20 is coupled to light-emitting device 22 through annular wall 24 to form a hermetically sealed enclosure 32 maintained at a low internal pressure level. Getter 26 and inert-gas reservoir 28 are accessible to sealed enclosure 32 and, for exemplary purposes, are illustrated in FIG. 1*a* as being situated on electron-emitting device 20 within sealed enclosure 32. As discussed further below, getter 26 and reservoir 28 may access enclosure 32 in other ways. Electronic circuitry (not shown) for controlling the display may be situated over the exterior surface (lower surface in FIG. 1) of electron-emitting device 20.

Referring to FIG. 1*b*, spacers 30 are situated within sealed enclosure 32 between devices 20 and 22. Spacers 30 prevent external forces, such as the external-to-internal pressure differential of approximately 1 atm. from collapsing the display. Spacers 30 also maintain a largely uniform separation between devices 20 and 22. Each spacer 30 is typically shaped generally like a flat wall. This exemplary situation is depicted in FIG. 1*b* where spacers 30 extend parallel to one another in the row direction. Other shapes, such as posts, can be employed for spacers 30.

Electron-emitting device, or backplate structure, 20 consists of a generally flat electrically insulating backplate 40 and a group of layers and regions situated over the interior surface (upper surface in FIG. 1) of backplate 40. These layers and regions include a two-dimensional array of rows and columns of laterally separated electron-emissive regions 42. Each electron-emissive region 42 consists of one or more of electron-emissive elements (not separately shown here), such as cones, filaments, and randomly shaped particles, which emit electrons directed toward light-emitting device 22. Electron-emitting device 20 typically operates according to field emission in which each region 42 emits electrons when subjected to a suitable electrical potential. Device 20 can operate according to other electron-emission techniques such as thermal emission.

The layers and regions in electron-emitting device 20 also typically include an electron-focusing system 44 which helps focus the emitted electrons toward target areas of light-emitting device 22. Electron-focusing system 44 extends vertically beyond electron-emissive regions 42 in the example of FIG. 1. Items 46 and 48 respectively represent the typical trajectories of two electrons traveling from device 20 to device 22 after being emitting by regions 42.

Light-emitting device, or faceplate structure, 22 is formed with a generally flat electrically insulating faceplate 50 and a group of layers and regions situated over the interior surface (lower surface in FIG. 1) of faceplate 50. Faceplate 50 is transparent at least where visible light is intended to pass through faceplate 50 to produce the display's image on the exterior surface (upper surface in FIG. 1) of faceplate 50 at the front of the display. The layers and regions overlying faceplate 50 include a two-dimensional array of rows and columns of light-emissive regions 52, a patterned black matrix 54, and an anode (not separately shown here).

Light-emissive regions 52 emit light upon being struck by electrons. Each light-emissive region 52 is situated directly opposite a corresponding one of electron-emissive regions 42. Electrons emitted by each region 42 are thereby intended to strike corresponding light-emissive region 52 to produce suitable light. In a color implementation of the display, three consecutive light-emissive regions 52 in a row respectively emit red, green, and blue light when struck by electrons emitted from the three corresponding regions 42. The light emitted by elements 52 produces the display's image on the exterior faceplate surface.

Black matrix 54 laterally surrounds each light-emissive region 52 and appears dark, largely black, as viewed from the front of the display. Matrix 54 enhances the contrast of the display's image. In the example of FIG. 1, matrix 54 extends vertically beyond light-emissive regions 52.

The display's anode may be situated above or below light-emissive regions 52 and black matrix 54. When situated above components 52 and 54 so as to be further away from faceplate 50 than components 52 and 54, the anode is normally light reflective. This enables the anode to reflect forward some of the initially rear-directed light emitted by regions 52 so as to enhance the image intensity. When the anode is situated between faceplate 50, on one hand, and components 52 and 54 on the other hand, the anode is largely transparent.

Sealed enclosure 32 has an open space consisting of the portion of enclosure 32 not occupied by solid components such as spacers 30. During display operation, electrons are extracted from regions 42, typically by field emission. Various voltages, typically within 20–40 volts of one another, are applied to electron-emitting device 20 for extracting electrons from regions 42 and controlling the electron trajectories. Relative to these voltages, the anode in light-emitting device 22 is provided with a high electrical potential that attracts the extracted electrons toward light-emissive regions 52. Consequently, the extracted electrons pass through the open space in enclosure 32 and impinge on light-emitting device 22.

More particularly, the flat-panel CRT display of FIG. 1 has an active image-producing region consisting of an active electron-emitting portion, an active light-emitting portion, and an active intermediate portion. The active electron-emitting portion is formed with the portion of electron-emitting device 20 extending laterally from the first row of electron-emissive regions 42 to the last row of regions 42 and from the first column of regions 42 to the last column of regions 42. The active light-emitting portion is formed with the portion of light-emitting device 22 extending laterally from the first row of light-emissive regions 52 to the last row of regions 52 and from the first column of regions 52 to the last column of regions 52. The active intermediate portion consists of the portion of sealed enclosure 32 between the active electron-emitting portion and the active light-emitting portion. Electrons which are emitted by regions 42 and directed toward light-emitting device 22 pass through the active portion of enclosure 32 to the sides of spacers 30.

When the anode is a light-reflective layer situated over components 52 and 54, the electrons pass through the anode and strike light-emissive regions 52 to cause light emission. When the anode is a transparent layer situated below components 52 and 54, the electrons strike light-emissive regions 52 directly to produce light which passes through the anode. In either case, the display's image appears on the exterior surface of faceplate 50.

The open space in sealed enclosure 32 contains gas, i.e., atoms and molecules in gas phase, at a very low pressure compared to normal atmospheric pressure (approximately 760 torr). The internal pressure in enclosure 32, i.e., the pressure of all the gas in the open space of enclosure 32, is normally $5\times10^{-7}$–$10^{-1}$ torr. Part of the gas in enclosure 32 is inert gas of which there are six inert gases: helium, neon, argon, krypton, xenon, and radon. The gas, including the inert gas, is distributed in a relatively uniform manner throughout the open space in enclosure 32.

A very small, but important, portion of the electrons which are emitted by regions 42 in electron-emitting device 20 and which move through the open space in sealed enclosure 32 toward light-emitting device 22 during normal display operation collide with (or strike) atoms of the inert gas located in the open space of enclosure 32. Part of the inert-gas atoms lose electrons when struck by electrons emitted by regions 42 and thereby become positively charged ions. Although the inert gas is distributed throughout the open space in enclosure 32, nearly all of the inert-gas atoms which become positively charged ions upon being struck by electrons emitted by regions 42 is located in the active intermediate portion of enclosure 32 when those atoms undergo ionization. Because the anode in light-emitting device 22 is at a high electrical potential relative to the voltages present in the electron-emitting device 20, the positively charged inert-gas ions are attracted to electron-emitting device 20. Relative to the electrons traveling from electron-emitting device 20 toward light-emitting device 22, the positively charged inert-gas ions thereby travel backward toward electron-emitting device 20.

The positively charged inert-gas ions pick up speed, and thereby become more energetic, as they approach electron-emitting device 20. Some of the positively charged inert-gas ions impinge on electron-emissive regions 42. Upon reaching regions 42, those positively charged inert-gas ions bombard contaminant material situated on regions 42 according to the mechanism of ion etch (or ion milling). This causes contaminant on regions 42 to be dislodged from regions 42. At least part of the dislodged contaminant typically becomes volatile, i.e. is converted to gaseous form. The dislodged contaminant moves away from regions 42. Nearly all of the dislodged contaminant consists of non-inert material, i.e., material other than the six inert gases. Part of non-inert dislodged contaminant reaches getter 26 and is collected by getter 26 so as to be prevented from re-contaminating regions 42.

Some of the non-inert dislodged contaminant material invariably returns to electron-emissive regions 42. To the extent that part of the non-inert volatized contaminant returns to regions 42 and re-contaminates them, this material is re-bombarded in the course of the ion etch mechanism that results from the electron-produced positive ionization of the inert gas present in the open space of enclosure 32. The material that re-contaminates regions 42 is again dislodged from regions 42 and moves away from them. Part of this now dislodged contaminant is similarly collected by getter 26 so as to prevent it from further re-contaminating regions 42. A situation is thus reached in which the ion etch mechanism acts to clean regions 42 as they become contaminated by both new contaminant material and previously removed contaminant material. By suitably adjusting the species and partial pressure(s) of the inert gas in enclosure 32, the ion etch mechanism can be controlled so that regions 42 are maintained in a substantially clean condition for a long time.

Getter 26 collects non-inert material such as the vast majority of the dislodged contaminant material as well as other non-inert, typically volatile, material present in the open space of sealed enclosure 32. Getter 26 does not significantly collect inert gas. Consequently, the presence of getter 26 does not cause a significant reduction in the amount of inert gas present in enclosure 32. However, some of the positively charged inert-gas ions impinge on portions of electron-emitting device 20 with sufficient energy to become lodged (or implanted) in device 20 and thus become effectively lost. As discussed further below, inert-gas reservoir 28 provides additional inert gas to replace the inert gas which is lost, for example, due to being lodged in device 20 in the course of the ion etch process.

The ion etch action in the self-cleaning process of the invention generally becomes stronger as the positively charged inert-gas ions are made more energetic. For a given positive potential on the display's anode, the positively charged inert-gas ions become more energetic as their average molecular weight increases. Also, the probability of an inert-gas atom being ionized upon being struck by an electron increases as the atom's atomic number, and thus the atom's molecular weight, increases. The molecular weights of the six inert gases increase in going from helium respectively through neon, argon, krypton, and xenon to radon. Hence, the ion etch action provided by a given number of atoms of inert gas achieves a progressively higher etch rate as the inert gas is changed from helium to neon, to argon, to krypton, to xenon, and finally to radon.

A given number of atoms of inert gas produce largely the same partial pressure irrespective of the constituency of the inert gas in the display. Since the ion etch rate increases as the average molecular weight of the inert gas increases, the partial pressure needed to achieve a given level of ion etch with the present inert gas decreases as the average inert-gas molecular weight increases. Accordingly, the partial pressure needed to achieve a given level of ion etch generally decreases in going from helium respectively through neon, argon, krypton, and xenon to radon.

In accordance with the invention, the partial pressure of all the inert gas in the open space of sealed enclosure 32 is normally at least $5\times10^{-7}$ torr. The inert gas in the open space of enclosure 32 can be variously constituted with helium, neon, argon, krypton, xenon, and radon at various partial pressures. All six of these inert gases are invariably present in enclosure 32 to some degree.

The lowest pressure of inert gas that can be measured in sealed enclosure 32 using standard residual gas analyzer equipment is in the vicinity of $1\times10^{-7}$ torr. Except as otherwise indicated, a specific inert gas present in the open space of enclosure 32 at a partial pressure of less than approximately $1\times10^{-7}$ torr is ignored in the following description.

The inert gas present in sealed enclosure 32 can, as generally indicated above, be constituted with any one or more of helium, neon, argon, krypton, xenon, and radon. Argon is attractive because it is the most prevalent inert gas, by far, in air and thus is relatively inexpensive compared to the other inert gases. Xenon and krypton are attractive because their relatively high molecular weights allow the partial pressure of the inert gas in enclosure 32 to be made relatively low, thereby reducing the amount of interference that the inert gas has with the electrons flowing from electron-emitting device 20 to light-emitting device 22.

For the case where the inert gas in sealed enclosure 32 is constituted with helium, the partial pressure of the helium is normally at least $2\times10^{-5}$ torr. The helium partial pressure is preferably at least $5\times10^{-5}$ torr, more preferably at least $1\times10^{-4}$ torr, and even more preferably at least $5\times10^{-4}$ torr. The partial pressure of the helium in enclosure 32 is normally no more than $1\times10^{-1}$ torr. The helium partial pressure is preferably no more than $5\times10^{-2}$ torr, more preferably no more than $1\times10^{-2}$ torr, and even more preferably no more than $5\times10^{-3}$ torr.

When the inert gas in sealed enclosure 32 is constituted with neon, the partial pressure of the neon is normally at least $1\times10^{-5}$ torr. The neon partial pressure is preferably at least $2\times10^{-5}$ torr, more preferably at least $5\times10^{-5}$ torr, and even more preferably at least $1\times10^{-4}$ torr The partial pressure of the neon in enclosure 32 can be as high as $10^{-1}$ torr but is normally no more than $5\times10^{-2}$ torr. The neon partial pressure is preferably no more than $1\times10^{-2}$ torr, more preferably no more than $5\times10^{-3}$ torr, and even more preferably no more than $1\times10^{-3}$ torr.

For the case in which the inert gas in sealed enclosure 32 is constituted with argon, the partial pressure of the argon is normally at least $1\times10^{-5}$ torr, preferably at least $2\times10^{-5}$ torr, when inert-gas reservoir 28 is present. When reservoir 28 is absent, the argon partial pressure is slightly higher, normally at least $3\times10^{-5}$ torr, preferably at least $4\times10^{-5}$ torr. In either case, the argon partial pressure is more preferably at least $5\times10^{-5}$ torr, even more preferably at least $1\times10^{-4}$ torr. The partial pressure of the argon in enclosure 32 can be as high as $10^{-1}$ torr but is normally no more than $1\times10^{-2}$ torr. The argon partial pressure is preferably no more than $5\times10^{-3}$ torr, more preferably no more than $1\times10^{-3}$ torr, and even more preferably no more than $5\times10^{-4}$ torr.

When the inert gas in sealed enclosure 32 is krypton, the partial pressure of the krypton is normally at least $1\times10^{-6}$ torr. The krypton partial pressure is preferably at least $2\times10^{-6}$ torr, more preferably at least $5\times10^{-6}$ torr, and even more preferably at least $1\times10^{-5}$ torr. The partial pressure of the krypton in sealed enclosure 32 can be as high as $1\times10^{-1}$ torr but is normally no more than $5\times10^{-3}$ torr. The krypton partial pressure is preferably no more than $1\times10^{-3}$ torr, more preferably no more than $5\times10^{-4}$ torr, and even more preferably no more than $1\times10^{-4}$ torr.

For the case where the inert gas in sealed enclosure 32 consists of xenon or radon, the partial pressure of the xenon or radon is normally at least $5\times10^{-7}$ torr, the minimum level given above for all the inert gas in enclosure 32. The xenon or radon partial pressure is preferably at least $1\times10^{-6}$ torr, more preferably at least $2\times10^{-6}$ torr, and even more preferably at least $5\times10^{6}$ torr. The partial pressure of the xenon or radon in sealed enclosure 32 can be as high as $1\times10^{-1}$ torr but is normally no more than $1\times10^{-3}$ torr. The xenon or radon partial pressure is preferably no more than $5\times10^{-4}$ torr, more preferably no more than $1\times10^{-4}$ torr, and even more preferably no more than $5\times10^{-5}$ torr.

The inert gas in sealed enclosure 32 may consist of two or more of helium, neon, argon, krypton, xenon, and radon where each of the two or more inert gases is present at a partial pressure of at least the typical minimum measurable partial pressure of approximately $1\times10^{-7}$ torr. In that case, the minimum value of the partial pressure of all the inert gas normally present in enclosure 32 can be determined by appropriately averaging the above-mentioned normal minimum partial pressure values for the six inert gases as a function of the molar fractions of the inert gases in enclosure 32. The maximum value of the partial pressure of all the inert gas normally present in enclosure 32 can similarly be determined by appropriately averaging the above-mentioned normal maximum partial pressure values for the six inert gases as a function of the molar fractions of the inert gases in enclosure 32. Because two or more inert gases are present in enclosure 32 at partial pressures greater than or equal to the typical minimum measurable value, the actual normal minimum or normal maximum value of each constituent inert gas will then be less than the normal minimum or normal maximum value given above for that gas. Similar averaging procedures apply to the preferred, more preferred, and even more preferred partial pressure conditions given above when two or more of the inert gases are present in enclosure 32 at partial pressures greater than or equal to the typical minimum measurable partial pressure.

Getter 26 is illustrated schematically in FIG. 1*a* as a single component but may, and often does, consist of multiple spaced-apart components. FIG. 1*a* also depicts getter 26 as being situated over backplate 40 outside the active image-producing region of the flat-panel CRT display. Alternatively or additionally, getter 26 may be situated over faceplate 50 outside the display's active region or/and over the inside surface of outer wall 26 and thus again outside the display's active region. Getter 26 can also alternatively or additionally be located in an auxiliary compartment situated outside sealed enclosure 32 and connected to enclosure 32 by way of one or more openings through backplate 40, faceplate 50, or/and outer wall 24. U.S. Pat. No. 5,977,706 present examples for implementing getter 26 in this manner.

As another variation, getter 26 can alternatively or additionally be located in the active image-producing region of the flat-panel CRT display in such a manner as to not interfere with the display's image-producing function. In that case, the material of getter 26 is typically distributed laterally in a relatively uniform manner across the display's active region. For instance, the getter material can be distributed in a relatively uniform manner across the top (upper surface in FIG. 1) of the active electron-emitting portion of electron-emitting device 20 as generally described in Curtin et al., U.S. patent application Ser. No. 09/698,696, filed 27 Oct. 2000. By having the getter material distributed across the top of the active electron-emitting portion, the volatized contaminant material that leaves electron-emissive regions 42 can be collected by getter 26 before that contaminant material leaves the immediate vicinity of regions 42. This improves the efficiency of the gettering process.

The material of getter 26 can likewise be distributed in a relatively uniform manner across the top (lower surface in FIG. 1) of the active light emitting portion of light-emitting device 22. See Cummings et al, U.S. patent application Ser. No. 09/823,872, filed 30 Mar. 2001, now U.S. Pat. No. 6,630,786 B2, as well as Curtin et al, U.S. patent application Ser. No. 09/698,696, cited above, for examples of how getter 26 is implemented in this way. As described in U.S. patent applications 09/823,872 and 09/698,696, candidate materials for getter 26 include magnesium, aluminum, titanium, vanadium, chromium, manganese, iron, cobalt, copper, zirconium, niobium, molybdenum, palladium, silver, barium, tantalum, tungsten, platinum, lead, thorium, magnesium oxide, chromium oxide, manganese oxide, cobalt oxide, nickel oxide, and lead oxide.

Getter 26 is normally porous. Contaminant material, typically gaseous, gathers along or near the outside surface of getter 26, causing its gettering capability to decrease as time passes. By appropriately treating the getter material according to an "activation" process, the material accumulated along or near the outside surface of getter 26 is driven into its interior. This enables getter 26 to regain much of its gettering capability up to the point at which the internal material-holding capability of getter 26 is reached. Getter 26 can typically be activated a large number of times.

Getter 26 is created before hermetically sealing the light-emitting and electron-emitting devices together to assemble the flat-panel CRT display. In a typical fabrication sequence, the completed light-emitting device is exposed to air prior to the display sealing operation. Contaminant material then accumulates along much of the effective gettering surface of getter 26. Accordingly, getter 26 typically needs to be activated during or subsequent to the display sealing operation while sealed enclosure 32 is at a high vacuum.

Activation of getter 26 can be done in various ways. Getter 26 can be activated by raising its temperature to a sufficiently high value, typically 300–900° C., for a sufficiently long period of time. In general, the amount of time needed to activate getter 26 decreases with increasing activation temperature. By sealing the display at a temperature in excess of 300° C., typically 350° C., in a highly evacuated environment, the activation can be automatically accomplished during the sealing operation. When a component adjoining getter 26 contains electrically resistive material, a voltage can sometimes be applied to the resistive material to raise its temperature high enough to activate getter 26.

As mentioned above, some of the inert gas present in sealed enclosure 32 is effectively lost, for example, due to becoming lodged (or trapped) in electron-emitting device 20 in the course of the self-cleaning ion etch process. Reservoir 28 supplies inert gas to the open space in enclosure 32 to compensate, at least partially, for the inert gas that lodges in device 20 or is otherwise lost. The inert gas provided by reservoir 28 typically has roughly the same composition as the inert gas present in enclosure 32 directly after the final display sealing operation. In any event, the characteristics of inert-gas reservoir 28 are preferably chosen so that the rate at which reservoir 28 furnishes inert gas to enclosure 32 roughly balances the rate at which the open space in enclosure 32 loses inert gas over the life of the display.

Inert-gas reservoir 28 is depicted schematically in FIG. 1*a* as a single component. However, reservoir 28 may consist of multiple components spaced apart from one another. FIG. 1*a* also illustrates reservoir 28 as being situated over backplate 40 outside the display's active image-producing region. Alternatively or additionally, reservoir 28 can be situated over faceplate 50 outside the display's active region or/and over the inside surface of outer wall 24, likewise outside the active region. Similar to getter 26, reservoir 28 can also alternatively or additionally be located in an auxiliary compartment situated outside sealed enclosure 32 and connected to enclosure 32 by way of one or more openings through backplate 40, faceplate 50, or/and outer wall 24. This auxiliary compartment may also contain (part or all of) getter 26.

Figure 2A:
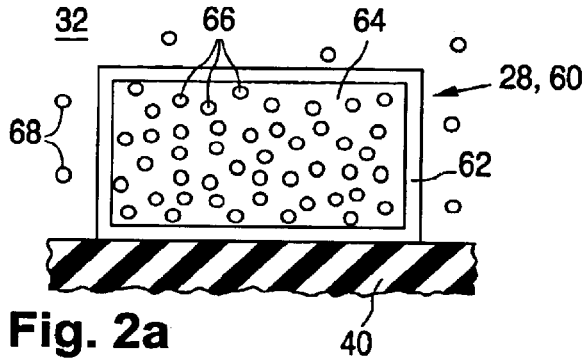
FIGS. 2*a*, 2*b*, 3–6, 7*a*, and 7*b* are cross sectional side views of implementations of the inert-gas reservoir in the flat-panel CRT display of FIGS. 1*a* and 1*b*.
Figure 2B:
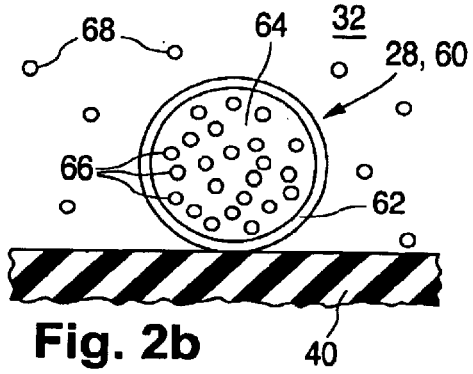

Aside from consisting of multiple spaced-apart components, inert-gas reservoir 28 can be configured in various ways. FIGS. 2*a* and 2*b* illustrate two implementations of reservoir 28 configured as a container 60 formed with a container wall 62 that fully surrounds an enclosed region 64 where the replacement inert gas is located. In the implementation of FIGS. 2*a* and 2*b*, the replacement inert gas consists of freely moving inert-gas atoms 66 whose movement is constrained substantially only by container wall 62. Although all of wall 62 can be gas permeable, wall 62 is gas permeable along at least part of the portion of wall 62 exposed to sealed enclosure 32. Inert-gas atoms 66 pass through wall 62 at a controlled rate to enter enclosure 32. Items 68 in FIGS. 2*a* and 2*b* represent the inert-gas atoms in the open space of enclosure 32.

FIG. 2*a* presents an implementation in which container 60 is shaped generally like a rectangular box or like a cylinder as viewed (in cross section) perpendicular to the axis of the cylinder. FIG. 2*b* presents an implementation in which container 60 is shaped like a sphere or like a circular cylinder as viewed (in cross section) along the axis of the cylinder. Container 60 can have various other shapes. As discussed further below, the replacement inert gas present in enclosed region 64 of container 60 can also be provided from sources other than freely moving inert-gas atoms 66.

Figure 3:
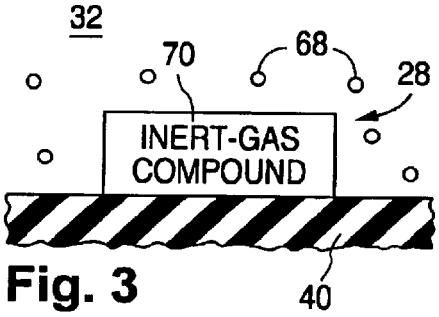

FIG. 3 illustrates an implementation of inert-gas reservoir 28 consisting of inert-gas compound 70. Candidates for inert-gas compound 70 include argon hydrofluoride (ArHF), krypton fluoride ($KrF_2$), xenon fluoride ($XeF_2$), xenon platinum fluoride ($XePtF_6$), xenon hydrocyanide (XeHCN), and xenon hydrochloride (XeHCl). These inert-gas compounds are generally unstable and slowly dissociate to release the replacement inert gas. Although FIG. 3 illustrates inert-gas compound 70 as being in contact with backplate 40, some of the exemplary inert-gas compounds identified here are liquids or gases, and thus need further supporting/retaining structures such as a piece of material that adsorbs or/and absorbs compound 70 or a container that holds compound 70.

Figure 4:
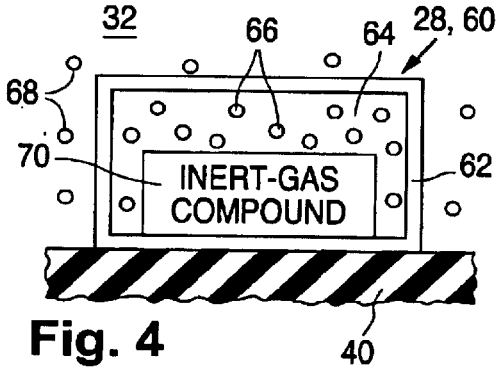

FIG. 4 presents an implementation of inert-gas reservoir 28 that combines the inert-gas compound implementation of FIG. 3 with the container implementation of FIGS. 2*a* and 2*b*. In FIG. 4, reservoir 28 is implemented as container 60 in which the replacement inert gas is provided from inert-gas compound 70 situated in enclosed region 64. Since compound 70 is fully enclosed by region 64, compound 70 can be a solid, a liquid, or a gas.

Figure 5:
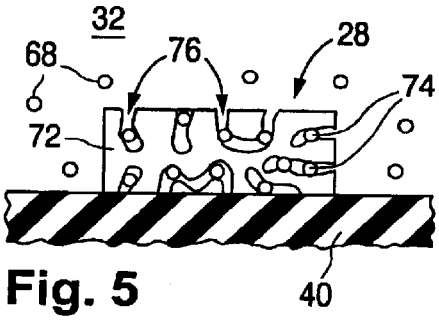

FIG. 5 illustrates an implementation of inert-gas reservoir 28 in which a piece 72 of porous absorbent material is charged with atoms 74 of the replacement inert gas. Absorbent piece 72 has pores 76 in which inert-gas atoms 74 are situated. Inert-gas atoms 74 slowly escape from pores 76 and enter the open space of sealed enclosure 32 where they are identified as inert-gas atoms 68.

For inert-gas atoms 74 to escape slowly from pores 76 in absorbent piece 72, the average diameter of pores 76 needs to match the average diameter of replacement inert-gas atoms 74. Candidate absorbent materials having appropriate average pore diameters suitable for implementing absorbent piece 72 when the replacement gas is krypton whose atomic diameter is approximately 0.35 nm include Zeolite KA, Erionite K, carbon molecular sieve material, porous aluminum oxide, and pillar clay. When the replacement inert gas is xenon whose atomic diameter is approximately 0.4 nm, candidate sorbent materials suitable for implementing absorbent piece 72 to match the atomic diameter of xenon include Zeolite NaA, Zeolite CaA, carbon molecular sieve material, porous aluminum oxide, and pillar clay.

Figure 6:
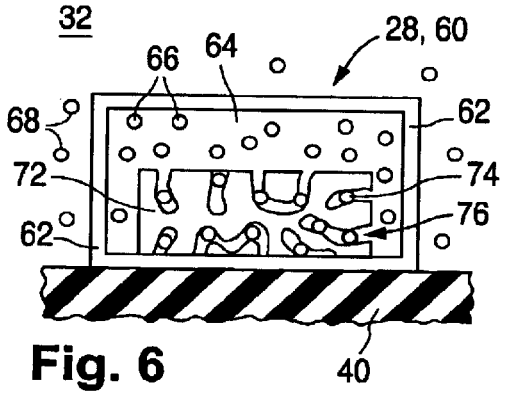

FIG. 6 presents an implementation of inert-gas reservoir 28 that combines the porous absorbent material implementation of FIG. 5 with the container implementation of FIGS. 2*a* and 2*b*. In FIG. 6, reservoir 28 is implemented as container 60 in which atoms 74 of the replacement inert gas are provided from absorbent piece 72 situated in enclosed region 64. Inert-gas atoms 74 situated in pores 76 of absorbent piece 72 escape pores 76 to become freely moving inert-gas atoms 66 located inside enclosed region 64. Inert-gas atoms 66 pass slowly through outer wall 62 of container 60 to become inert-gas atoms 68 in the open space of sealed enclosure 32.

Figure 7A:
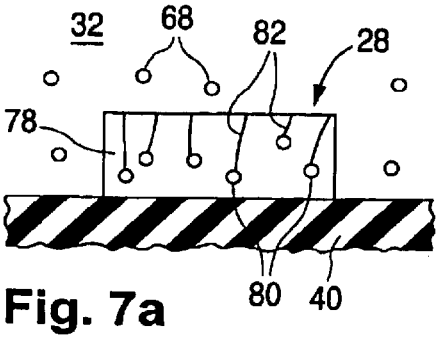
Figure 7B:
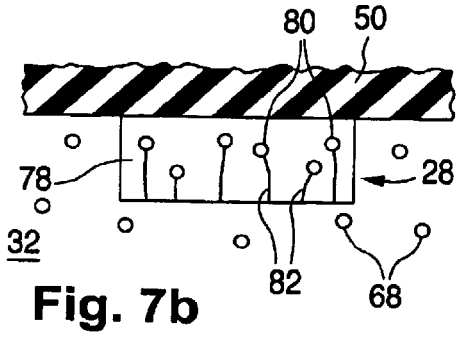

FIGS. 7*a* and 7*b* illustrate two implementations of inert-gas reservoir 28 consisting of a piece 78 of material impregnated with atoms 80 of the replacement inert gas. Items 82 in FIGS. 7*a* and 7*b* represent the paths along which replacement inert-gas atoms 80 enter piece 78 to become impregnated. The impregnation of piece 78 can be done by ion implanting inert-gas atoms 80 into piece 78. The impregnation of piece 78 can also be done by sputtering atoms 80 toward piece 78. Somewhat similar to reservoir 28 in FIG. 5, impregnated inert-gas atoms 80 slowly leave impregnated piece 78 along paths 82 to become inert-gas atoms 68 in the open space of sealed enclosure 32.

It may be necessary to activate impregnated piece 78 to cause impregnated inert-gas atoms 80 to leave piece 78. The activation can be achieved by having positively charged inert-gas ions impinge on piece 78. As shown in the example of FIG. 7*a*, piece 78 is then situated over backplate 40. The activation of impregnated piece 78 can alternatively be done by having electrons emitted from regions 42 impinge on piece 78. In that case, piece 78 is situated over faceplate 50 as shown in the example of FIG. 7*b*.

Figure 8:
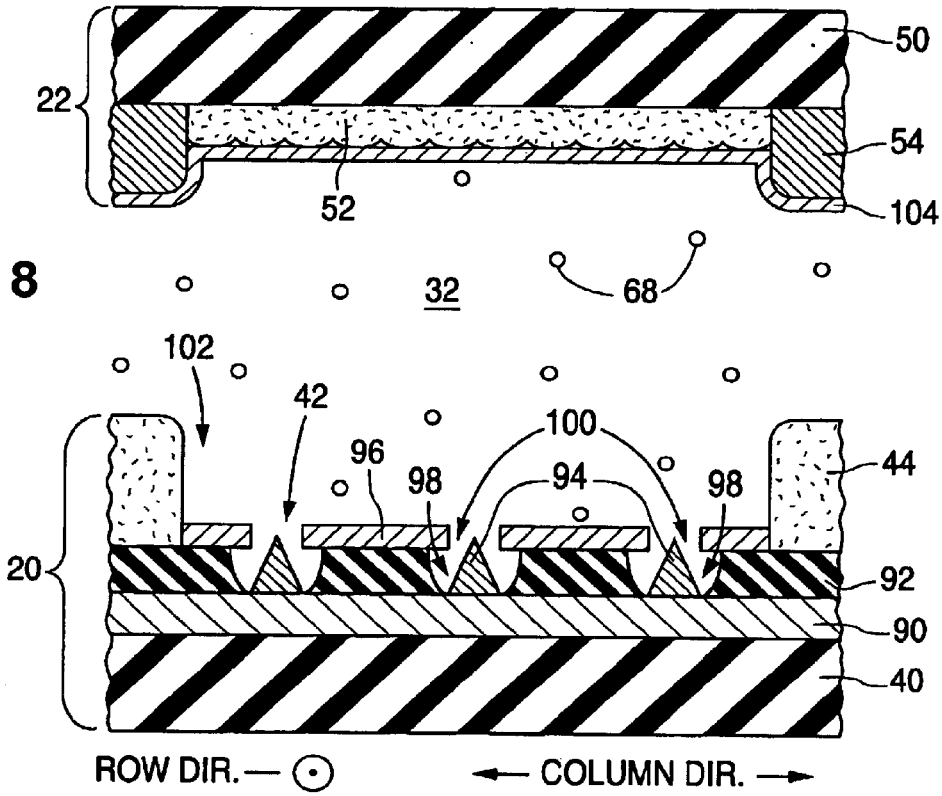
FIG. 8 is a cross sectional side view of part of the active region of an implementation of the flat-panel CRT display of FIGS. 1*a* and 1*b* directly after display sealing and getter activation.

FIG. 8 presents a side cross section of part of the active image-producing region of an implementation of the hermetically sealed flat-panel CRT display of FIG. 1 immediately subsequent to final display sealing and getter activation. The cross section of FIG. 8 is indicated in FIG. 8 as being a cross section viewed in the row direction but can as well be a cross section viewed in the column direction.

The layers and regions situated directly over backplate 40 of electron-emitting device 20 in the flat-panel CRT display of FIG. 8 consists of a lower electrically non-insulating region 90, a dielectric layer 92, a two-dimensional array of laterally separated sets of electron-emissive elements 94, a group of laterally separated generally parallel control electrodes 96, and electron-focusing system 44. Each set of electron-emissive elements 94 consists of multiple elements 94 and forms one of electron-emissive regions 42. Only one set of elements 94 is illustrated in FIG. 8. Likewise, only one control electrode 96 is depicted in FIG. 8.

Lower non-insulating region 90 contains a group of laterally separated generally parallel emitter electrodes (not separately shown) situated on backplate 40. The emitter electrodes extend longitudinally in the column direction. Lower non-insulating region 90 also normally includes an electrically resistive layer (likewise not separately shown) which overlies the emitter electrodes and, depending on its lateral shape, may extend down to backplate 40 in the spaces between the emitter electrodes. At a minimum, the resistive layer underlies electron-emissive elements 94.

Dielectric layer 92 lies on lower non-insulating region 90. Openings 98 extend through dielectric layer 92 down to non-insulating region 90. Each electron-emissive element 94 is situated mostly in a corresponding one of dielectric openings 98 and contacts region 90. Electron-emissive elements 94 are typically conical in shape as indicated in FIG. 8. Alternatively, elements 94 can be of filamentary shape. When elements 94 are conical or filamentary in shape, they typically consist of metal such as molybdenum. Each element 94 can also consist of one or more randomly shaped particles. Control electrodes 96 lie on dielectric layer 92 and extend in the row direction. Openings 100 extend through control electrodes 96. Each electron-emissive element 94 is exposed through a corresponding one of control openings 100.

Electron-focusing system 44 lies on dielectric layer 92 and extends over portions of control electrodes 96 (outside the plane of FIG. 8). A two-dimensional array of rows and columns of focus openings 102 extend through system 44. Each column of focus openings 102 is situated above a corresponding one of control electrodes 96. The electron-emissive elements 94 in each electron-emissive region 42 are exposed through a corresponding one of focus openings 102.

Control electrodes 96 selectively extract electrons from elements 94 in electron-emissive regions 42. Electron-focusing system 44 focuses the extracted electrons toward target ones of light-emissive regions 52 in the light-emitting device. System 44 helps overcome undesired electron-trajectory deflections caused by various factors such as the presence of spacers, e.g., spacer walls 30 shown in FIG. 1*b*, located between devices 20 and 22.

A metallic light-reflective layer 104, which serves as the display's anode, overlies light-emissive regions 52 and black matrix 54 of light-emitting device 22 in the implementation of FIG. 8. As in the figures that present particular implementations of inert-gas reservoir 28, items 68 in FIG. 8 are atoms of the inert gas present in the open space of sealed enclosure 32. Reservoir 28, which is normally positioned outside the display's active image-producing portion, does not appear in FIG. 8 since it illustrates part of the display's active region.

Getter 26 also does not appear in FIG. 8. However, as indicated above, getter 26 can be distributed laterally across the active electron-emitting portion of device 20 or/and across the active light-emitting portion of device 22. For instance, as described in Curtin et al, U.S. patent application Ser. No. 09/698,696, cited above, getter 26 can be provided in openings in electron-focusing system 44 so as to be quite close to electron-emissive elements 94.

Figure 9:
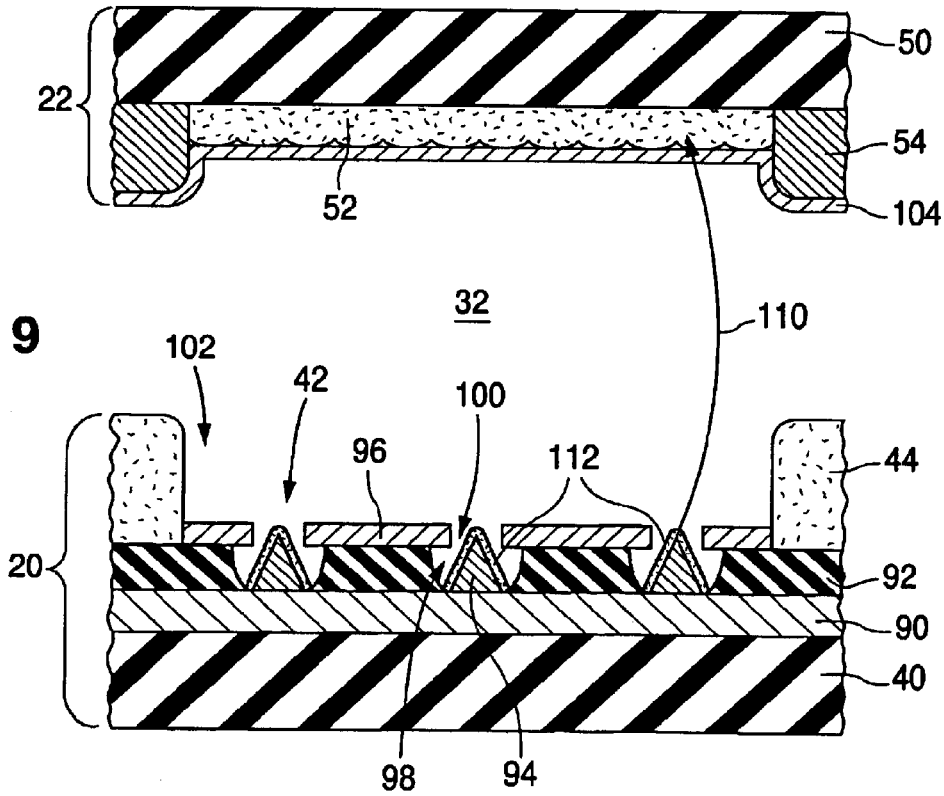
FIG. 9 is a cross-sectional side view of part of the active region of an implementation of a flat-panel CRT display generally corresponding to that of FIG. 8 but not provided with the self-cleaning capability of the invention.

To pictorially illustrate the advantages furnished by the present invention, FIG. 9 presents a side cross section of part of the active image-producing region of an implementation of a hermetically sealed baseline flat-panel CRT display identical to the implementation of FIG. 8 except that the open space of sealed enclosure 32 in the baseline implementation of FIG. 9 effectively has zero inert gas compared to the open space of enclosure 32 in the inventive implementation of FIG. 8. FIG. 9 also represents an instance of time at which the baseline display is in operation and has been operating for some significant period of time. Item 110 in FIG. 9 represents the trajectory of an electron emitted by one of elements 94.

As FIG. 9 indicates, coatings 112 of contaminant material have accumulated on the conical surfaces of electron-emissive elements 94. Since effectively no inert gas is present in the open space of sealed enclosure 32 in the baseline implementation of FIG. 9, the emission of electrons from elements 94 of the illustrated electron-emissive region 42 does not produce the ion etch process of the invention to a significant degree. Contaminant coatings 112 thus remain on elements 94 in the baseline display and cause its performance to degrade. In fact, contaminant coatings 112 grow with time as the display is being operated so that its performance becomes progressively worse.

More particularly, contaminant coatings 112 cause the amount of electron emission from electron-emissive elements 94 to degrade with time during display operation. Although contaminant coatings 112 are, for simplicity, illustrated as substantially fully covering the conical surfaces of elements 94 in FIG. 9, coatings 112 can cause significant degradation in the electron emission even though their average thickness is only a fraction of an atomic monolayer so that coatings 112 are perforated or/and discontinuous.

Additional contaminant material may be present inside the baseline display of FIG. 9 at locations other than the conical surfaces of electron-emissive elements 94. For example, additional contaminant may accumulate on electron-focusing system 44 or/and control electrodes 96 in electron-emitting device 20 or above light-emissive elements 52 in light-emitting device 22. Although the additional contaminant which accumulates on light-emitting device 22 may affect its performance, the additional contaminant which accumulates on device 22 or on parts of electron-emitting device 20 other than electron-emissive elements 94 will generally not significantly damage the electron-emitting capability of device 20 in the baseline display of FIG. 9. Inasmuch as the present invention is directed toward cleaning electron-emissive regions 42 in such a way as to avoid loss in their electron-emitting capability, contaminant that accumulates inside the baseline display of FIG. 9 at locations other than the conical surfaces of electron-emissive elements 94 is, for simplicity, not illustrated in FIG. 9.

Figure 10A:
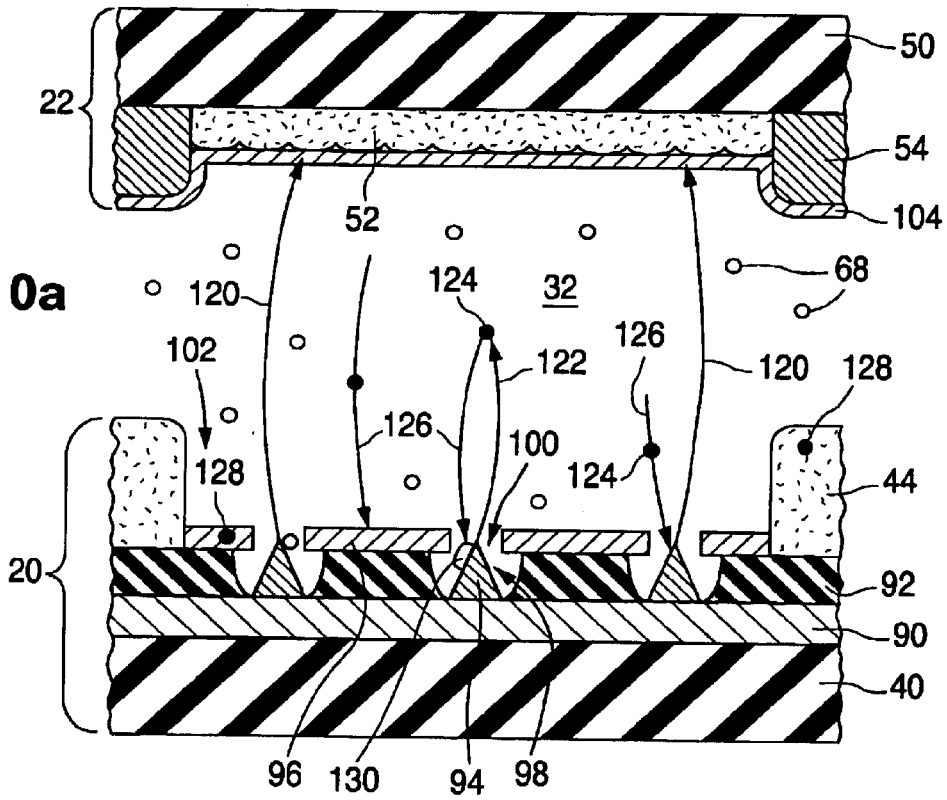
FIGS. 10*a* and 10*b* are cross-sectional side views of part of the active region of the implementation of the flat-panel CRT display of FIG. 8 respectively at an instance of time during normal display operation and at a later instance of time when the display is not in operation.
Figure 10B:
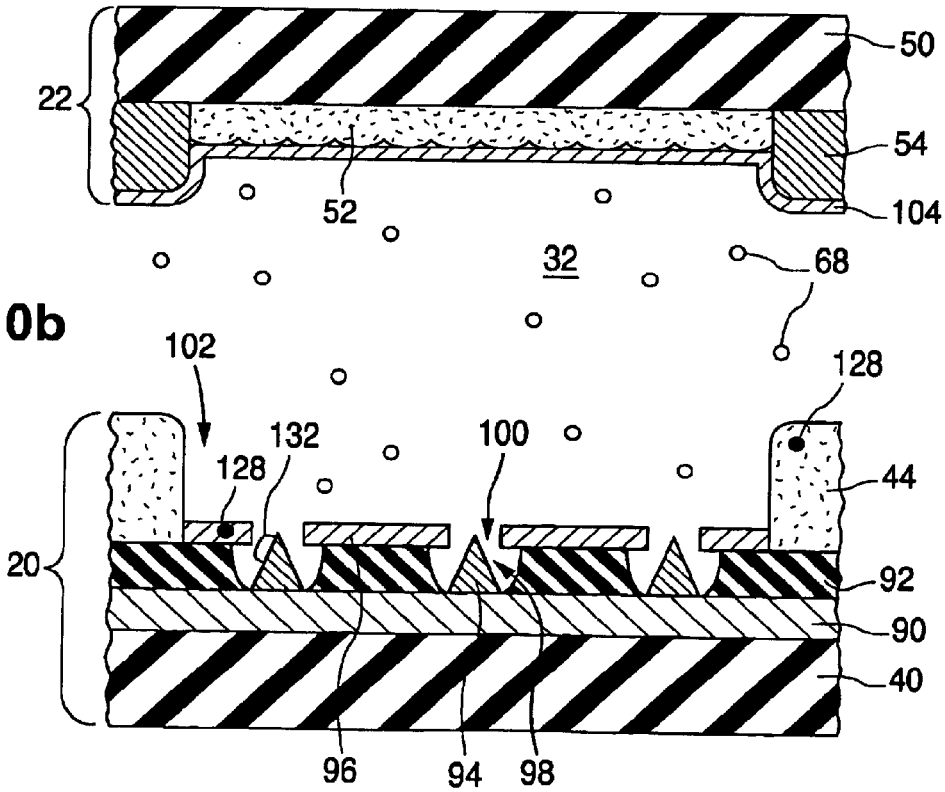

FIGS. 10*a* and 10*b* present side cross sections of part of the active image-producing region of an implementation of the flat-panel CRT display of FIG. 8 at two respective instances of time where the implementation of FIG. 8 has been operated for approximately the same amount of time as the baseline implementation of FIG. 9. FIG. 10*a* represents an instance of time at which the display of FIG. 8 is in operation. In this regard, FIG. 10*a* qualitatively illustrates how electron-emissive regions 42 are cleaned according to the ion etch process of the invention. FIG. 10*b* represents a somewhat later instance of time at which the display of FIG. 8 has been turned off.

In FIG. 10*a*, items 120 represent the trajectories of electrons which are emitted by elements 94 of the illustrated electron-emissive region 42 and which reach the oppositely situated light-emissive region 52 to cause light emission. Item 122 represents the trajectory of an electron which is emitted by one of elements 94 and which strikes one of inert-gas atoms 68. Items 124 in FIG. 10*a* are positively charged inert-gas ions which are produced from inert-gas atoms 68 when they are struck by electrons emitted by elements 94. Items 126 represent the trajectories of positively charged inert-gas ions 124 as they travel backward to electron-emitting device 20.

As mentioned above, some of the positively charged inert-gas ions lodge in electron-emitting device 20 during the ion etch process of the invention. The positively charged inert-gas ions that lodge in device 20 pick up electrons and become neutral inert-gas atoms again. Items 128 in FIG. 10*a* represent positively charged inert-gas atoms that lodge in device 20 as a result of the ion etch self-cleaning process of the invention. Finally, item 130 in FIG. 10*a* is a piece of contaminant material that accumulates on the conical surface of one of electron-emissive elements 94.

The ion etch mechanism of the present invention is depicted qualitatively in FIG. 10*a*. Nonetheless, FIG. 10*a* illustrates how trajectory 126 followed by one of positively charged inert-gas ions 124 takes that ion 124 directly back to contaminant piece 130. As a result of being bombarded (or struck) by that ion 124, contaminant piece 130 is dislodged from underlying electron-emissive element 94 and moves away from that element 94. In moving away from underlying element 94, contaminant piece 130 is in the form of one or more particles which may be solid or gaseous depending on the size of each particle.

Contaminant piece 130 does not appear in FIG. 10*b* which illustrates the display of FIG. 8 at a later instance of time when the display is turned off. Hence, FIG. 10*b* shows how the display has been cleaned in accordance with the invention to remove contaminant 130 from electron-emissive element 94 on which contaminant 130 had earlier accumulated. During display operation, further contaminant material accumulates on electron-emissive elements 94. Item 132 in FIG. 10*b* represents a further piece of contaminant material that accumulates on one of elements 94. In the course of later display operation, further contaminant 132 is also removed from underlying element 94 as a result of ion etch process of the invention.

FIGS. 10*a* and 10*b* together show that contaminant material which accumulates on electron-emissive elements 94 is progressively removed during display operation. As can be seen by comparing FIG. 10*b* to FIG. 9, the amount of contaminant present on elements 94 at any instance of time is much less in the inventive display of FIG. 8 than in the baseline display of FIG. 9 where the self-cleaning ion etch process does not occur to a significant degree. Configuring the display of FIG. 8 to have the present self-cleaning capability thereby enables elements 94 to be maintained in a highly clean condition for a substantially increased period of operational time.

Similar to what was said above about the baseline display of FIG. 9, additional contaminant material may accumulate inside the inventive display of FIG. 8 at locations other than electron-emissive elements 94. As with FIG. 9, this additional contaminant is, for simplicity, not illustrated in FIG. 8 or in FIG. 10*a* or 10*b* because the additional contaminant would generally not significantly damage the electron-emitting capability of device 20 in the display of FIG. 8. Nonetheless, the additional contaminant which accumulates on device 20 at locations other than elements 94 in the display of FIG. 8 is generally removed by the ion etch process of the invention in the course of removing the contaminant that accumulates on elements 94. For instance, contaminant that accumulates over control electrodes 96 is removed simultaneously with contaminant that accumulates on elements 94. All portions of electron-emissive regions 42, along with other parts of device 20 in the active electron-emitting portion, are automatically cleaned during display operation.

The general flat-panel CRT display of FIG. 1, including the implementation of FIG. 8, is fabricated in largely the following manner. Devices 20 and 22 are separately manufactured. If getter 26 is to be incorporated into the active image-producing region of the display, the manufacture of device 20 or/and device 22 is performed in such a way as to appropriately incorporate getter 26 into device 20 or/and device 22. Otherwise, getter 26 is simply mounted over backplate 40, faceplate 50, or/and outer wall 24 depending on where getter 26 is to be located in the display. Inert-gas reservoir 28 is also mounted over backplate 40, faceplate 50, or/and outer wall 24 depending on where reservoir 28 is to be located in the display.

Spacers 30 are mounted on device 20 or 22. Outer wall 24 is also mounted on device 20 or 22. The assembly of the display is largely completed by sealing device 20 to device 22 through wall 24. During the assembly procedure, the display is provided with a tip-off tube (not shown) through which sealed enclosure 32 is externally accessible in the assembled, but not yet hermetically sealed, display.

The display is now hermetically sealed. The display sealing procedure is performed in a gaseous environment that contains inert gas at the desired molar fraction(s) suitable for achieving the desired initial partial pressure(s) of the desired inert gas(es) in the open space of sealed enclosure 32. More particularly, the assembled display is placed in a vacuum chamber. The vacuum chamber is evacuated, normally at elevated temperature. Inert gas of the desired composition is introduced into the vacuum chamber at room temperature or at elevated temperature. Part of the inert gas enters sealed enclosure 32 through the tip-off tube. The pressure of the inert gas introduced into the vacuum chamber is controlled so as to achieve the desired initial partial pressure for the inert gas in enclosure 32.

The tip-off tube is then closed by a suitable sealing technique in order to hermetically seal enclosure 32 and thus the display. The partial pressure in enclosure 32 is thereby set at the desired initial value, normally $5\times10^{-7}$–$1\times10^{-1}$ torr, which is typically approximately the same as the pressure in the vacuum chamber. Air is subsequently introduced into the vacuum chamber after which the hermetically sealed display is removed from the vacuum chamber.

Directional terms such as "lateral", "vertical", "above", and "below" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here. The terms "row" and "column" are arbitrary relative to each other and can be reversed.

While the invention has been described with reference to particular embodiments, this description is solely for the purpose of illustration and is not to be construed as limiting the scope of the invention claimed below. Field emission includes the planar phenomenon generally termed surface conduction emission. Various modifications and applications may thus be made by those skilled in the art without departing from the true scope and spirit of the invention as defined in the appended claims.

We claim:

1. A structure comprising:

an electron-emitting device which comprises a backplate and an array of laterally separated electron-emissive regions situated over the backplate, each electron-emissive region comprising at least one electron-emissive element;

a light-emitting device coupled to the electron-emitting device to form a hermetically sealed enclosure through which electrons emitted by the electron-emissive regions pass to strike the light-emitting device and cause it to emit light that produces an image; and inert gas located in open space of the sealed enclosure, the inert gas consisting of at least one of (a) helium at a partial pressure of at least $2\times10^{-5}$ torr and (b) at least one of neon, krypton, xenon, and radon at a partial pressure of at least $5\times10^{-7}$ torr.

2. A structure as in claim 1 wherein the structure is a flat-panel display.

3. A structure as in claim 1 wherein the light-emitting device comprises:

a faceplate; and an array of laterally separated light-emissive regions situated over the faceplate, each light-emissive region situated opposite a corresponding different one of the electron-emissive regions.

4. A structure as in claim 1 wherein the electron-emissive regions emit electrons according to field emission.

5. A structure as in claim 1 wherein the inert gas comprises at least one of (a) neon at a partial pressure of at least $1\times10^{-5}$ torr and (b) krypton at a partial pressure of at least $1\times10^{-6}$ torr.

6. A structure as in claim 1 wherein the inert gas comprises at least one of (a) helium at a partial pressure of at least $5\times10^{-5}$ torr, (b) neon at a partial pressure of at least $2\times10^{-5}$ torr, (c) krypton at a partial pressure of at least $2\times10^{-6}$ torr, and (d) at least one of xenon and radon at a partial pressure of at least $1\times10^{-6}$ torr.

7. A structure as in claim 1 wherein the inert gas comprises at least one of (a) helium at a partial pressure of at least $1\times10^{-4}$ torr, (b) neon at a partial pressure of at least $5\times10^{-5}$ torr, (c) krypton at a partial pressure of at least $5\times10^{-6}$ torr, and (d) at least one of xenon and radon at a partial pressure of at least $2\times10^{-6}$ torr.

8. A structure as in claim 1 further including a getter for collecting non-inert contaminant material present in the sealed enclosure.

9. A structure as in claim 8 wherein the electron-emitting device has an active electron-emitting portion across which electrons are emitted from the electron-emissive regions, the getter being distributed across the active electron-emitting portion.

10. A structure as in claim 1 further including a reservoir for supplying further inert gas to the open space of the sealed enclosure.

11. A structure as in claim 1 wherein the inert gas is at a partial pressure of no more than $1\times10^{-1}$ torr.

12. A structure as in claim 1 wherein the inert gas comprises at least one of (a) helium at a partial pressure of no more than $1\times10^{-1}$ torr, (b) neon at a partial pressure of no more than $5\times10^{-2}$ torr, (c) krypton at a partial pressure of no more than $5\times10^{-3}$ torr, and (d) xenon or radon at a partial pressure of no more than $1\times10^{-3}$ torr.

13. A structure comprising:

an electron-emitting device which comprises a backplate and an array of laterally separated electron-emissive regions situated over the backplate, each electron-emissive region comprising at least one electron-emissive element;

a light-emitting device coupled to the electron-emitting device to form a hermetically sealed enclosure through which electrons emitted by the electron-emissive regions pass to strike the light-emitting device and cause it to emit light that produces an image;

inert gas located in open space of the sealed enclosure at a partial pressure of at least $5\times10^{-7}$ torr; and a container that encloses inert gas, the container having a wall through which further inert gas passes from the container to the open space of the sealed enclosure.

14. A structure as in claim 13 wherein the structure is a flat-panel display.

15. A structure as in claim 13 wherein the light-emitting device comprises:

a faceplate; and an array of laterally separated light-emissive regions situated over the faceplate, each light-emissive region situated opposite a corresponding different one of the electron-emissive regions.

16. A structure as in claim 13 wherein the electron-emissive regions emit electrons according to field emission.

17. A structure as in claim 13 wherein the container is situated in the sealed enclosure.

18. A structure as in claim 13 wherein the wall is gas permeable.

19. A structure as in claim 13 wherein at least part of the inert gas in the container is in gaseous form.

20. A structure as in claim 13 wherein at least part of the inert gas in the container is in inert-gas compound form.

21. A structure as in claim 13 wherein at least part of the inert gas in the container is present in inert-gas absorbent-material form.

22. A structure as in claim 13 further including a getter for collecting non-inert contaminant material present in the sealed enclosure.

23. A structure as in claim 22 wherein the electron-emitting device has an active electron-emitting portion across which electrons are emitted from the electron-emissive regions, the getter being distributed across the active electron-emitting portion.

24. A structure as in claim 13 wherein the inert gas comprises at least one of (a) helium at a partial pressure of at least $2\times10^{-5}$ torr, (b) at least one of neon and argon at a partial pressure of at least $1\times10^{-5}$ torr, (c) krypton at a partial pressure of at least $1\times10^{-6}$ torr, and (d) at least one of xenon and radon at a partial pressure of at least $5\times10^{-7}$ torr.

25. A structure as in claim 13 wherein the inert gas comprises at least one of (a) helium at a partial pressure of at least $5\times10^{-5}$ torr, (b) at least one of neon and argon at a partial pressure of at least $2\times10^{-5}$ torr, (c) krypton at a partial pressure of at least $2\times10^{-6}$ torr, and (d) at least one of xenon and radon at a partial pressure of at least $1\times10^{-6}$ torr.

26. A structure as in claim 13 wherein the inert gas is at a partial pressure of no more than $1\times10^{-1}$ torr.

27. A structure as in claim 13 wherein the inert gas comprises at least one of (a) helium at a partial pressure of no more than $1\times10^{-1}$ torr, (b) neon at a partial pressure of no more than $5\times10^{-2}$ torr, (c) argon at a partial pressure of no more than $1\times10^{-2}$ torr, (d) krypton at a partial pressure of no more than $5\times10^{-3}$ torr, and (e) xenon or radon at a partial pressure of no more than $1\times10^{-3}$ torr.

28. A method of cleaning a structure comprising an electron-emitting device and a light-emitting device coupled to the electron-emitting device to form a hermetically sealed enclosure through which electrons emitted by an array of laterally separated electron-emissive regions of the electron-emitting device pass to strike the light-emitting device and cause it to emit light that produces an image, open space of the sealed enclosure containing inert gas consisting of at least one of (a) helium at a partial pressure of at least $2\times10^{-5}$ torr and (b) at least one of neon, krypton, xenon, and radon at a partial pressure of at least $5\times10^{-7}$ torr, the method comprising operating the electron-emitting device so that part of the electrons emitted by the electron-emissive regions collide with atoms of the inert gas to produce inert-gas ions which bombard contaminant material situated over the electron-emitting device in the sealed enclosure and cause at least part of the contaminant material to be dislodged from the electron-emitting device.

29. A method as in claim 28 wherein the structure is a flat-panel display.

30. A method as in claim 28 wherein the electron-emissive regions are situated over a backplate of the electron-emitting device, each electron-emissive region comprising at least one electron-emissive element, the contaminant material attacked by the inert-gas ions comprising contaminant material situated over the electron-emissive elements.

31. A method as in claim 28 wherein the inert gas comprises at least one of (a) neon at a partial pressure of at least $1\times10^{-5}$ torr and (b) krypton at a partial pressure of at least $1\times10^{-6}$ torr.

32. A method as in claim 28 wherein the inert gas comprises at least one of (a) helium at a partial pressure of at least $5\times10^{-5}$ torr, (b) neon at a partial pressure of at least $2\times10^{-5}$ torr, (c) krypton at a partial pressure of at least $2\times10^{-6}$ torr, and (d) at least one of xenon and radon at a partial pressure of at least $1\times10^{-6}$ torr.

33. A method as in claim 28 further including collecting non-inert material, including particles of the dislodged contaminant material, present in the sealed enclosure.

34. A method as in claim 28 further including supplying the open space of the sealed enclosure with further inert gas.

35. A method as in claim 34 further including collecting non-inert material, including particles of the dislodged contaminant material, present in the sealed enclosure.

36. A method as in claim 28 wherein the light-emitting device comprises:

a faceplate; and an array of laterally separated light-emissive regions situated over the faceplate, each light-emissive region situated opposite a corresponding different one of the electron-emissive regions.

37. A method of cleaning a structure comprising an electron-emitting device and a light-emitting device coupled to the electron-emitting device to form a hermetically sealed enclosure through which electrons emitted by an array of laterally separated electron-emissive regions of the electron-emitting device pass to strike the light-emitting device and cause it to emit light that produces an image, open space of the sealed enclosure containing inert gas at a partial pressure of at least $5\times10^{-7}$ torr, the method comprising:

operating the electron-emitting device so that part of the electrons emitted by the electron-emissive regions collide with atoms of the inert gas to produce inert-gas ions which bombard contaminant material situated over the electron-emitting device in the sealed enclosure and cause at least part of the contaminant material to be dislodged from the electron-emitting device; and supplying the open space of the sealed enclosure with further inert gas from a container having a wall through which the further inert gas passes from the container to the open space of the sealed enclosure.

38. A method as in claim 37 wherein the structure is a flat-panel display.

39. A method as in claim 37 wherein the electron-emissive regions are situated over a backplate of the electron-emitting device, each electron-emissive region comprising at least one electron-emissive element, the contaminant material bombarded by the inert-gas ions comprising contaminant material situated over the electron-emissive elements.

40. A method as in claim 37 further including collecting non-inert material, including particles of the dislodged contaminant material, present in the sealed enclosure.

41. A method as in claim 37 wherein the further inert gas supplied to the open space of the sealed enclosure compensates at least partially for inert-gas ions that lodge in the electron-emitting device.

42. A method as in claim 41 further including collecting non-inert material, including particles of the dislodged contaminant material, present in the sealed enclosure.

43. A method as in claim 37 wherein the inert gas comprises at least one of (a) helium at a partial pressure of at least $2\times10^{-5}$ torr, (b) at least one of neon and argon at a partial pressure of at least $1\times10^{-5}$ torr, (c) krypton at a partial pressure of at least $1\times10^{-6}$ torr, and (d) at least one of xenon and radon at a partial pressure of at least $5\times10^{-7}$ torr.

44. A method as in claim 37 wherein the inert gas comprises at least one of (a) helium at a partial pressure of at least $5\times10^{-5}$ torr, (b) at least one of neon and argon at a partial pressure of at least $2\times10^{-5}$ torr, (c) krypton at a partial pressure of at least $2\times10^{-6}$ torr, and (d) at least one of xenon and radon at a partial pressure of at least $1\times10^{-6}$ torr.

45. A method as in claim 37 wherein the light-emitting device comprises:

a faceplate; and an array of laterally separated light-emissive regions situated over the faceplate, each light-emissive region situated opposite a corresponding different one of the electron-emissive regions.

46. A structure comprising:

an electron-emitting device;

a light-emitting device coupled to the electron-emitting device to form a hermetically sealed enclosure through which electrons emitted by the electron-emitting device pass to strike the light-emitting device and cause it to emit light that produces an image;

inert gas located in open space of the sealed enclosure at a partial pressure of at least $5\times10^{-7}$ torr; and a container that encloses inert gas, the container having a wall through which inert gas passes from the container to the open space of the sealed enclosure.

47. A structure as in claim 46 wherein the structure is a flat-panel display.

48. A structure as in claim 46 wherein the wall is gas permeable.

49. A structure as in claim 46 wherein at least part of the inert gas in the container is in gaseous form.

50. A structure as in claim 46 wherein at least part of the inert gas in the container is in inert-gas compound form.

51. A structure as in claim 46 wherein at least part of the inert gas in the container is present in inert-gas absorbent-material form.

52. A structure as in claim 46 further including a getter for collecting non-inert contaminant material present in the sealed enclosure.

53. A structure as in claim 52 wherein the electron-emitting device has an active electron-emitting portion across which electrons are emitted from the electron-emitting device, the getter being distributed across the active electron-emitting portion.

54. A structure as in claim 46 wherein the inert gas comprises at least one of (a) helium at a partial pressure of at least $2\times10^{-5}$ torr, (b) at least one of neon and argon at a partial pressure of at least $1\times10^{-5}$ torr, (c) krypton at a partial pressure of at least $1\times10^{-6}$ torr, and (d) at least one of xenon and radon at a partial pressure of at least $5\times10^{-7}$ torr.

55. A structure as in claim 46 wherein the inert gas comprises at least one of (a) helium at a partial pressure of at least $5\times10^{-5}$ torr, (b) at least one of neon and argon at a partial pressure of at least $2\times10^{-5}$ torr, (c) krypton at a partial pressure of at least $2\times10^{-6}$ torr, and (d) at least one of xenon and radon at a partial pressure of at least $1\times10^{-6}$ torr.

56. A structure as in claim 46 wherein the inert gas is at a partial pressure of no more than $1\times10^{-1}$ torr.

57. A structure as in claim 46 wherein the inert gas comprises at least one of (a) helium at a partial pressure of no more than $1\times10^{-1}$ torr, (b) neon at a partial pressure of no more than $5\times10^{-2}$ torr, (c) argon at a partial pressure of no more than $1\times10^{-2}$ torr, (d) krypton at a partial pressure of no more than $5\times10^{-3}$ torr, and (e) xenon or radon at a partial pressure of no more than $1\times10^{-3}$ *torr*.

58. A structure comprising:

an electron-emitting device which comprises a backplate and an array of laterally separated electron-emissive regions situated over the backplate, each electron-emissive region comprising at least one electron-emissive element;

a light-emitting device coupled to the electron-emitting device to form a hermetically sealed enclosure through which electrons emitted by the electron-emissive regions pass to strike the light-emitting device and cause it to emit light that produces an image;

inert gas located in open space of the sealed enclosure at a partial pressure of at least $5\times10^{-7}$ torr; and a reservoir for supplying further inert gas to the open space of the sealed enclosure, the reservoir comprising at least one piece of inert-gas compound material.

* * * * *